US007401421B2

(12) United States Patent
Brennan

(10) Patent No.: US 7,401,421 B2
(45) Date of Patent: Jul. 22, 2008

(54) SOLE CONSTRUCTION

(76) Inventor: Timothy James Brennan, 3 St. Quintin Avenue, London (GB) W10 6NX ( * ) Notice: Subject to any disclaimer, the term of this patent is extended or adjusted under 35 U.S.C. 154(b) by 414 days.

(21) Appl. No.: 11/021,397

(22) Filed: Dec. 23, 2004

(65) Prior Publication Data

US 2005/0132614 A1 Jun. 23, 2005

(30) Foreign Application Priority Data

Dec. 23, 2003 (GB) ..... 0329813.0

(51) Int. Cl.
*A43B 23/00* (2006.01)

(52) U.S. Cl. ..... 36/30 R; 36/107; 36/73

(58) Field of Classification Search ..... 36/30 R, 36/73, 103, 104, 107, 32 R, 14
See application file for complete search history.

(56) References Cited

U.S. PATENT DOCUMENTS

| | | | | | |
|---|---|---|---|---|---|
| 1,776,106 | A | * | 9/1930 | Cooke | 36/14 |
| 3,416,174 | A | * | 12/1968 | Novitske | 12/142 E |
| 3,824,716 | A | * | 7/1974 | Di Paolo | 36/32 R |
| 4,366,634 | A | * | 1/1983 | Giese et al. | 36/114 |
| 4,481,726 | A | * | 11/1984 | Phillips | 36/30 A |
| 4,876,807 | A | * | 10/1989 | Tiitola et al. | 36/114 |
| 5,285,583 | A | * | 2/1994 | Aleven | 36/44 |
| 5,390,430 | A | * | 2/1995 | Fitchmun et al. | 36/30 R |
| 5,406,723 | A | * | 4/1995 | Okajima | 36/131 |
| 5,832,634 | A | * | 11/1998 | Wong | 36/107 |
| 5,979,081 | A | * | 11/1999 | Vaz | 36/107 |
| 5,987,782 | A | * | 11/1999 | Bramani | 36/107 |
| 5,992,056 | A | | 11/1999 | Lohrmann | |
| 5,996,255 | A | * | 12/1999 | Ventura | 36/44 |
| 6,167,639 | B1 | | 1/2001 | Ventura | |
| 6,505,421 | B1 | * | 1/2003 | Vaz | 36/30 R |
| 2002/0011011 | A1 | * | 1/2002 | Vaz | 36/73 |
| 2006/0021257 | A1 | * | 2/2006 | Hung | 36/73 |

FOREIGN PATENT DOCUMENTS

| | | |
|---|---|---|
| EP | 0667108 | 8/1995 |
| WO | WO 96/26655 | 9/1996 |
| WO | WO 2004/089143 | 10/2004 |

* cited by examiner

*Primary Examiner*—Marie Patterson
(74) *Attorney, Agent, or Firm*—Andrus, Sceales, Starke & Sawall, LLP

(57) ABSTRACT

A sole construction for use in the manufacture of a shoe has an outer sole made of a soft and pliable natural or synthetic elastomeric material having a substantially uniform thickness over its entire area. The outer sole has a substantially planar external surface (when relaxed) for contacting the ground, with cuts formed therein to enhance grip. A puncture-resistant inner sheet of woven synthetic fibers is bonded to the internal surface of the outer sole and an inner lining is bonded to the puncture-resistant inner sheet. A removable soft insole may be provided on the inner lining. The sole construction is lightweight and highly flexible such that a foot of a wearer may flex in the same manner as if the wearer was barefoot with the puncture-resistant inner sheet protecting the wearer's foot from accidental injury from sharp objects on which the wearer may tread.

19 Claims, 4 Drawing Sheets

SOLE CONSTRUCTION

CROSS REFERENCE TO RELATED APPLICATIONS

This invention claims the priority of UK Patent Application No. 0329813.0, filed on 23rd Dec. 2003.

BACKGROUND OF THE INVENTION a) Field of the Invention

This invention relates to a sole construction for a shoe and also to a shoe incorporating the sole construction of this invention.

b) Description of the Prior Art

A useful function of conventional shoes is to protect the foot of a wearer from sharp objects such as sharp stones, broken glass, drawing pins, nails, thorns and so on. The puncture resistance of the sole of a shoe is achieved by providing a sufficiently thick sole made from a material of adequate strength and hardness. For example, leather or natural or synthetic rubbers may be used, the material being selected to have the required strength, thickness and wear resistance. However, a conventional shoe has an adverse and potentially serious effect on the human locomotive system and can contribute to poor posture. Also, several harmful effects are associated with the use of a relatively hard and inflexible shoe sole.

In the case of a hard and relatively inflexible shoe sole, the following effects may be noted, which are even worse with a truly rigid sole:

a) The sole limits tactile perception through the foot, which can lead to overloading of the locomotive system since high foot impacts may not be detected.

b) The sole reduces the capacity of the foot for tactile sensation, leading to a reduction in foot comfort as the sense of touch becomes deadened.

c) A relatively inflexible sole restricts articulation of the joints in a foot. For example, when walking a foot should flex through about 550 at the point of step push-off, but with a typical shoe the foot flexes through only about 250. As a consequence, the foot has to work harder creating undue strain and fatigue.

d) A relatively inflexible or rigid sole usually is generally planar in the transverse direction, with a sharp corner at the outer edge of the sole. This can give a false sense of stability to a wearer of the shoe, as it can give resistance to lateral ankle rolling up to a particular point but once this limit is exceeded, then support is instantaneously lost. The common result is a sprained or is twisted ankle.

e) A relatively stiff and inflexible sole prevents the foot rolling over the ground with a smooth shock-absorbing action. Instead, the profile of the sole tends to cause a wearer to assume a 'slapping' jarring gait which can lead to various overloading-related injuries.

In the case of a relatively thick sole, the following effects may be noted:

f) With wear, a relatively thick sole can distort to take up a bow-shape (i.e. concave in the lengthwise direction, when viewed internally of the shoe), which will cause the metatarsal heads to lose their natural flat plane. In turn, this can contribute to the possibility of a fallen metatarsal arch.

g) A relatively thick sole can localise the weight distribution on the foot. With a barefoot print, the weight is shown to be distributed over the whole area of the foot—a broad heel, a lateral border, the ball region of the foot and toe imprints. By contrast, tread area of a thick sole on the ground may be only 65% to 85% of the weight bearing area of a bare foot, and with a thick and inflexible sole, this increases the local loading on the foot.

h) A thick sole tends to increase ankle instability because it increases the lever arm of the heel and causes unnaturally high stresses on the ankle. The thicker the sole, the greater the chance of a wearer suffering a twisted ankle.

g) A relatively thick sole will, in general, weigh significantly more than a thinner sole. Most shoes are too heavy for proper foot comfort and a thick sole will make a shoe even heavier. It has been shown that every added 100 g on the weight of a shoe may add another tonne to the daily foot lift-load. This foot lift-load imposes an energy drain not only on the foot but on the whole body. This is a common but little recognised source of foot and body fatigue.

BRIEF SUMMARY OF THE INVENTION

It is a principal aim of the present invention to provide a sole construction for a shoe which achieves the desirable characteristics of being flexible, thin and lightweight, but which is still puncture-resistant so as to protect the sole of the foot from injury during ordinary everyday wear.

According to this invention, there is provided a sole construction for a shoe comprising:

- an outer sole made of a soft and pliable natural or synthetic elastomeric material and having a substantially uniform thickness over its entire area, the outer sole having a substantially planar external surface for ground contact, an opposed inner surface and an up-turned marginal region for the attachment thereto of a shoe upper;
- a puncture-resistant inner sheet overlying the inner surface of the outer sole and comprising a woven fabric consisting of or including high strength flexible fibres; and
- an inner lining overlying the puncture-resistant inner sheet.

It will be appreciated that by manufacturing a shoe using the sole construction of this invention, the gait of the wearer will be closely similar to that were the wearer barefooted. This is because the sole has a substantially uniform thickness across its entire area and further is relatively soft and flexible, and so permits the foot to flex and roll in much the same way as the foot would do, were the wearer barefooted. When relaxed, the outer sole presents a substantially planar surface for contacting the ground though that surface may flex as required, during wear. However, the provision of the puncture-resistant inner sheet still serves to protect the sole of the wearer's foot from injury by objects encountered in everyday life, such as sharp stones, broken glass, drawing pins and so on.

This invention extends to a shoe comprising a sole construction of this invention as described above in combination with a shoe upper attached to the up-turned marginal region of the outer sole. That attachment may be achieved by one or both of stitching or bonding. In the alternative, the shoe upper may be attached to the marginal region by means of a releasable fastener, whereby the upper may be detached from the sole construction. The upper itself may take any conventional form for shoes or even boots.

BRIEF DESCRIPTION OF THE DRAWINGS

The drawings show a specific embodiment of sole construction of this invention and a shoe manufactured with the sole construction, though only by way of example. In the drawings.

DETAILED DESCRIPTION OF THE INVENTION

Figure 1:
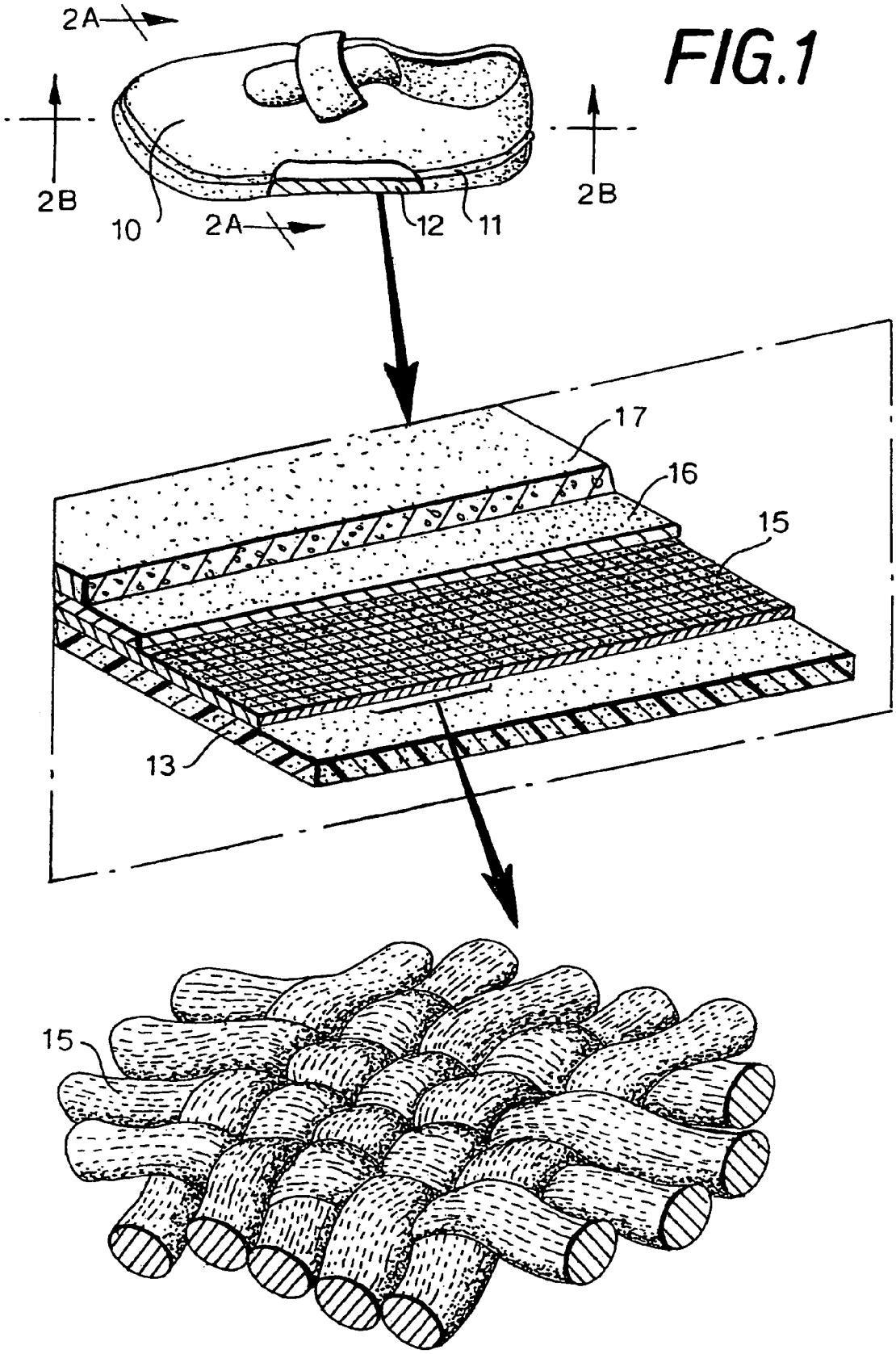
FIG. 1 diagrammatically illustrates a shoe incorporating a sole construction as an embodiment of this invention.

The invention relies upon the puncture-resistant inner sheet conferring sufficient protection to the foot-sole of a wearer of shoes utilising the sole construction, while allowing the foot to flex naturally as it would, were the wearer barefoot.

The flexible fibres of the puncture-resistant inner sheet are preferably tightly woven to render the fabric highly resistant to puncture by a sharp object. For example, the fabric may be woven from synthetic fibres such as of an aromatic polyamide and it has been found that a fabric woven from the fibres sold by DuPont under the trade mark Kevlar® is particularly suitable. The puncture resistance of such a fabric may be increased by embedding the fabric in a flexible resin matrix. The puncture resistance may be even more increased by providing two overlying layers of the fabric within a resin matrix, but there could be some loss of flexibility with a material with two-layers in a resin matrix.

Kevlar®-based fabrics are known per se and are used in view of their puncture resistance for example in the manufacture of knife-resistant body armour and for similar purposes where resistance to penetration by a sharp object is required. It has also been proposed, for example in U.S. Pat. No. 5,996,255 (Ventura), U.S. Pat. No. 6,167,639 (Ventura) and CA2227182 (Littleford) to incorporate such a Kevlar® layer in a shoe sole, but only in connection with work-boots or safety shoes, which have very substantial, thick and almost rigid soles, and so are quite dissimilar from, and cannot have the advantageous characteristics of, the present invention.

Preferably, the inner sheet is bonded to the inner surface of the outer sole, over substantially the whole area of that surface. The inner sheet preferably lies solely over the substantially planar surface of the sole but could extend over the up-turned marginal region as well, so as to assist in the attachment of the shoe upper to the sole construction.

Though the outer sole could be made of a suitable grade of natural rubber, it is preferred for the outer sole to be of a synthetic resin, such as a polyurethane and in particular thermoplastic polyurethane (TPU). Preferably, the hardness on the Shore A scale of the outer sole is not greater than 65, and advantageously is within the range of 42 to 54. Further, the substantially uniform thickness of the outer sole, as manufactured, should be of the order of 3 mm. The ground contacting surface of the outer sole may be textured in order to increase grip and slip resistance of a shoe incorporating the sole, when being worn.

The sole construction includes a lining, provided on the inner surface of the puncture-resistant inner sheet. That lining may be of a natural or synthetic leather material, bonded over the entire area of the inner sheet. Typically, the lining will have a thickness of the order of 1 mm.

Comfort when in use may be enhanced by providing the sole construction with a pliable insole, for example made in whole or in part from a resilient foam material. Such an insole advantageously is removable from the lining and so may be replaced in the event that it becomes worn, or for another insole having different characteristics, better to suit the preferences of a given wearer.

Referring now to the drawings, and FIG. 1 in particular, there is shown a shoe embodying a sole construction of this invention. The shoe comprises an upper 10 secured for example by bonding and stitching to an up-turned marginal region 11 of the sole construction 12, for the full periphery of that marginal region. The manufacture of a shoe upper and the bonding and stitching thereof to a sole in this way is well known and understood in the art; it will not be described in further detail here.

Figure 2A:
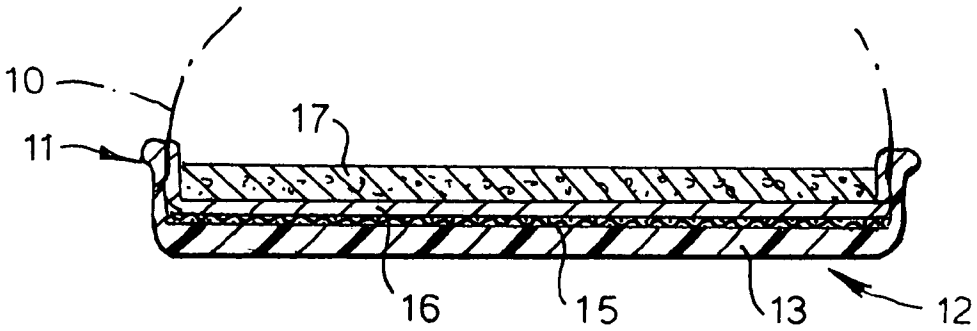
FIGS. 2A and 2B are vertical sections through the sole construction of the shoe of FIG. 1, taken respectively in the transverse and lengthwise directions of the sole as shown by section lines 2A-2A and 2B-2B marked on FIG. 1.
Figure 2B:
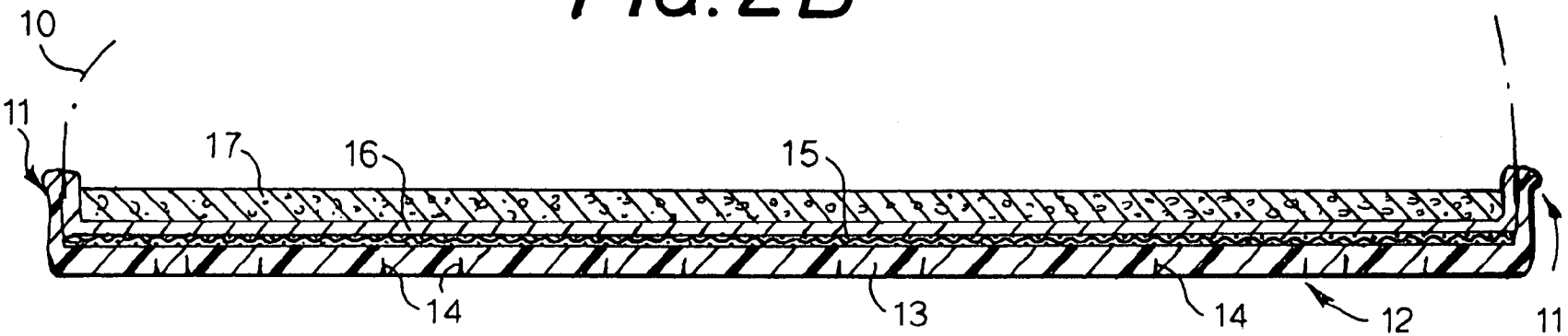

The sole construction 12 is shown in more detail in FIGS. 2A and 2B. As can be seen, this comprises an outer sole 13 formed of a thermoplastic polyurethane synthetic elastomer, selected to be relatively soft and pliable. The outer sole has a substantially uniform thickness over its entire major area and in this embodiment is approximately 3 mm thick, as moulded. As shown in FIGS. 2A and 2B, the up-turned marginal region 11 extends around the full periphery of the outer sole 13. The under-face of the outer sole 13 may be textured or provided with cuts 14, in order to enhance the grip of the sole with the ground and reduce the likelihood of slipping.

On the upper surface of the outer sole 13, there is provided a puncture-resistant sheet 15, made from a woven fabric of synthetic fibres, typically of an aromatic polyamide such as that material sold by DuPont under the trade mark Kevlar®. Such fabrics are well known in order to confer stab-proof properties on garments of various kinds, such as body armour. Such a fabric may have one or two layers of woven fibres, embedded in a resin matrix which has sufficient flexibility to permit a body armour garment to be worn in a normal manner. The fibres making up the fabric are of very high strength and resistant to cutting by a sharp point or blade, and also resistant to deformation so that the fibres cannot separate to permit the passage therethrough of a sharp implement. In this embodiment, the sheet 15 is woven from about 0.5 mm strands, bonded with a urethane resin.

The puncture-resistant sheet 15 has a thickness sufficient to give the sheet the required properties and typically will be of the order of 1 mm thick, or slightly less. The sheet is cut to fit the profile of the major area of the outer sole, so as to fit within the up-turned marginal region 11. The sheet is bonded with a suitable adhesive to the inner surface of the outer sole 13.

Bonded to the upper surface of the puncture-resistant sheet 15 is an inner lining 16, typically of a soft leather or imitation leather. That inner lining may also have a thickness of about 1 mm, and may extend up the marginal region 11. A resilient foam insole 17 is shown on top of the inner lining 16, in order to give comfort to a wearer of the shoe. The insole 17 is removable in order to allow it to be replaced should it become worn, or should a wearer require an insole having different properties, such as harder or softer foam. Such insoles are known in the shoe art and will not be described further here.

It will be appreciated that the shoe of FIGS. 1 and 2 has a relatively thin sole as compared to conventional rubber or leather soled shoes, and as a consequence also is relatively light in weight. As such, the wearing of the shoes is very much akin to being barefoot, without shoes. However, the sole of the foot is protected against accidental injury by the provision of the puncture-resistant inner sheet 15 provided within the sole construction 12, which is highly resistant to penetration by such sharp objects as may accidentally be walked on by the wearer of the shoes.

Figure 3:
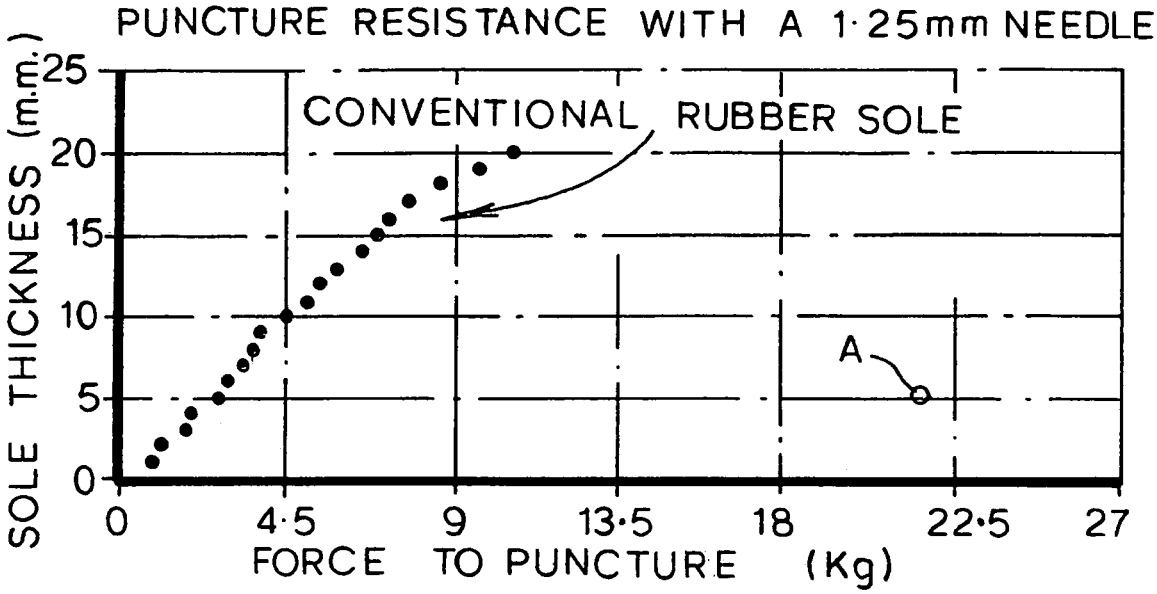
FIG. 3 is a graph plotting the puncture resistance of a conventional rubber shoe sole against the thickness of the sole, and also the puncture resistance of the embodiment of this invention.

The puncture resistance of the sole construction is explained in further detail with reference to the graphs of FIGS. 3, 4 and 5. In FIG. 3, there is plotted the resistance of a conventional rubber shoe sole to puncturing by a sharp needle of approximately 1.25 mm diameter, determined by the load applied to the needle in order to achieve penetration of the sole. As can be seen, with sole thicknesses below about 10 mm, the sole has only relatively low puncture resistance, but even by increasing the sole thickness up to 20 mm, the puncture resistance has risen only to about 11 kg (24 lb) for the test needle. By contrast, the sole construction of the described embodiment, shown at A on the graph, displays far higher puncture resistance, and of the order of twice that achieved with a 20 mm thick rubber sole.

Figure 4:
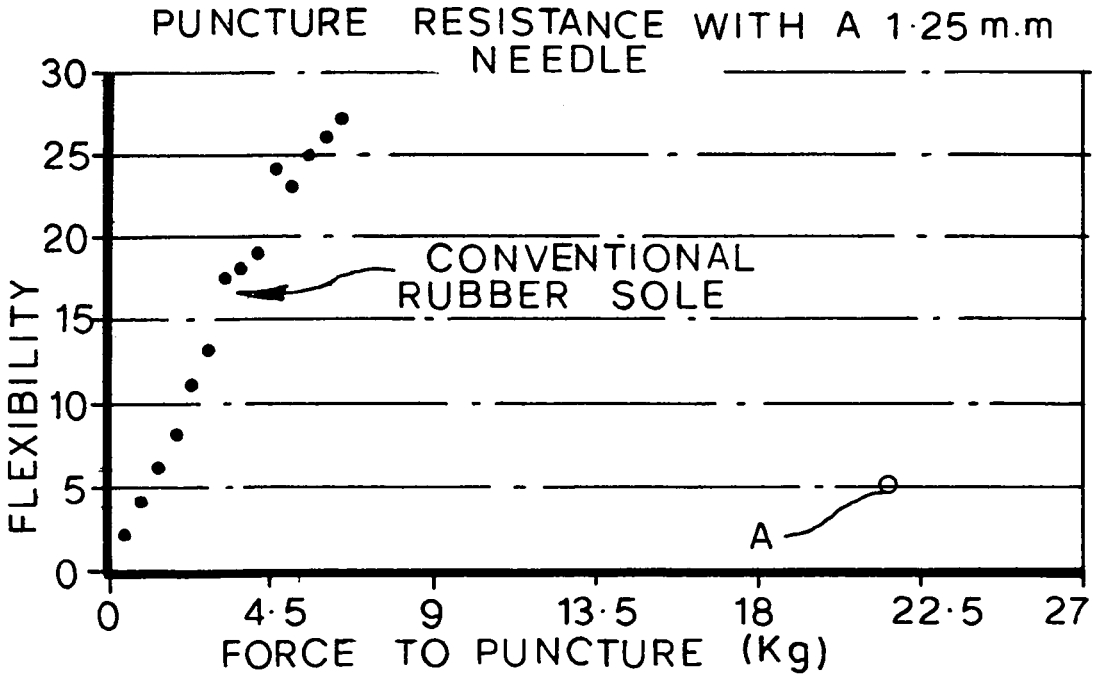
FIG. 4 is a graph plotting the flexibility of a conventional rubber sole against the thickness of the sole and also showing the embodiment of this invention.

FIG. 4 shows the puncture resistance of a conventional rubber sole plotted against the flexibility of the sole. Even with a relatively stiff sole, a puncture resistance of only about 7 kg is achieved for the test needle; this can be contrasted with the sole construction of the described embodiment, again shown at A on the graph, where the same puncture resistance is achieved as with the embodiment shown in FIG. 3.

Figure 5:
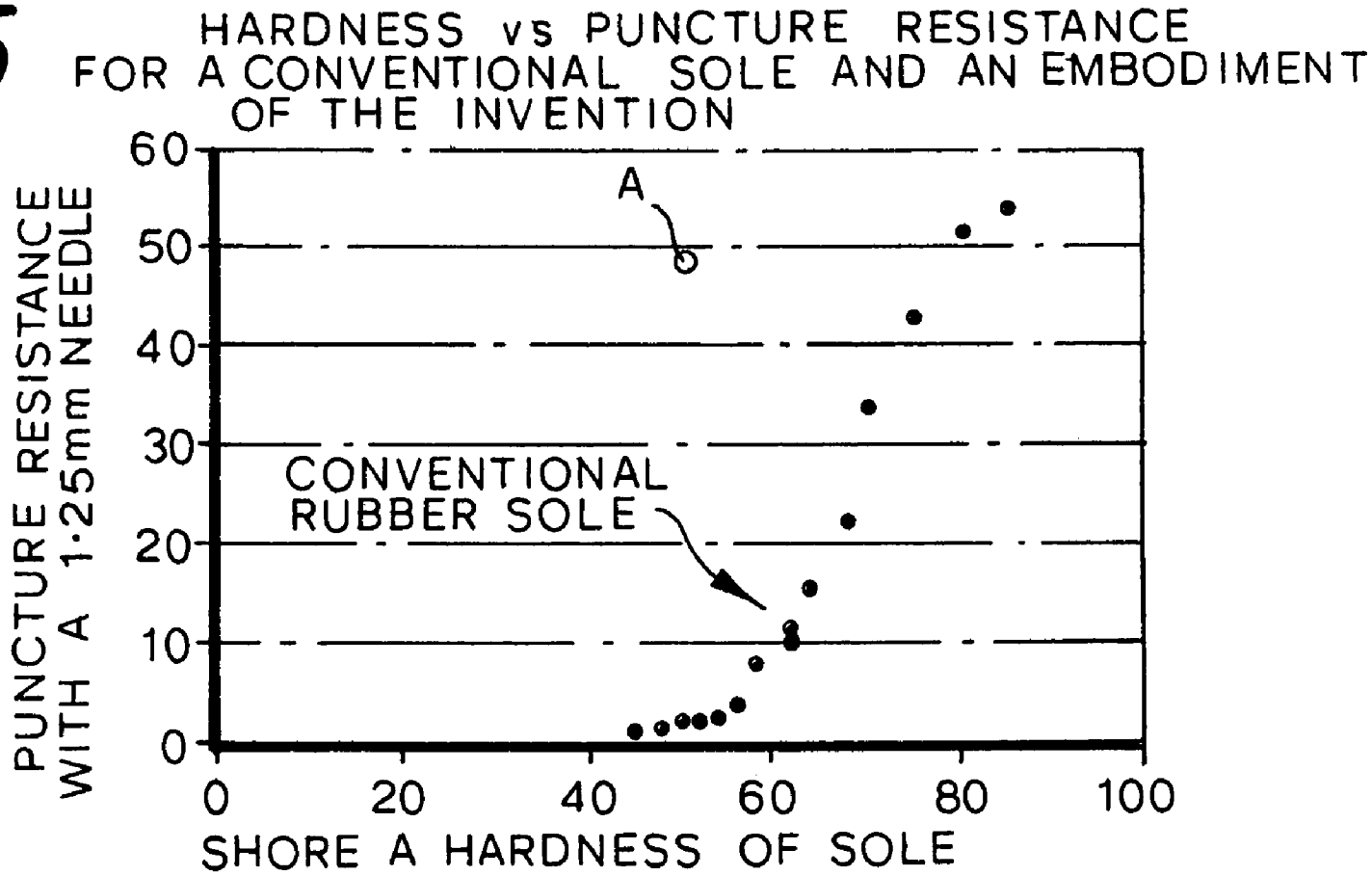
FIG. 5 is a graph plotting the hardness of a conventional rubber sole against its puncture resistance and also showing the embodiment of this invention.

FIG. 5 plots the Shore A hardness of a conventional rubber sole against the puncture resistance for the standard 1.25 mm needle used in the other tests. As can be seen, with a conventional rubber sole there is only a relatively slow increase in puncture resistance as the Shore A hardness rises from about 42 up to 60, but thereafter the puncture resistance rises relatively rapidly with increasing sole hardness. The sole construction of the embodiment is again shown at A, where the hardness on the Shore A scale is approximately 48 and yet a puncture resistance of approximately 22 kg is achieved, with the test needle.

From the foregoing, it will be understood that shoes manufactured with the sole construction of this invention are extremely resistant to puncturing notwithstanding the relatively thin and lightweight construction of the sole. It can be anticipated that all ordinary hazards encountered in normal wear will not penetrate the sole, while giving the wearer the benefit of very lightweight shoes, having a soft, thin and pliable sole, able to flex in sympathy with the natural flexing of the foot when walking, running and so on.

The invention claimed is:

1. A sole construction for a relatively flexible, thin and lightweight shoe comprising:

an outer sole made of a soft and pliable natural or synthetic elastomeric material and having a substantially uniform thickness over its entire area, the outer sole having a substantially planar external surface for ground contact, an opposed inner surface and an up-turned marginal region for the attachment thereto of a shoe upper;

a puncture-resistant inner sheet directly contacting and overlying the inner surface of the outer sole and comprising a woven fabric consisting of or including high strength flexible fibres; and an inner lining directly contacting and overlying the puncture-resistant inner sheet; wherein the puncture-resistant inner sheet allows the foot to flex naturally of a wearer of a shoe utilizing the sole construction.

2. A sole construction as claimed in claim 1, wherein the flexible fibres of the inner sheet are tightly woven to render the fabric highly resistant to puncture by a sharp object.

3. A sole construction as claimed in claim 1, wherein the fibres of the woven fabric are embedded in a flexible resin matrix.

4. A sole construction as claimed in claim 1, wherein the inner sheet comprises two overlying layers of a woven fabric the overlying layers having similar properties.

5. A sole construction as claimed in claim 1, wherein the woven fabric comprises or includes synthetic fibres.

6. A sole construction as claimed in claim 5, wherein the woven fabric consists of or includes fibres of an aromatic polyamide.

7. A sole construction as claimed in claim 1, wherein the inner sheet is bonded to the inner surface of the outer sole, over substantially the whole of the area of said inner surface.

8. A sole construction as claimed in claim 1, wherein the substantially uniform outer sole thickness is not greater than 5 mm.

9. A sole construction as claimed in claim 8, wherein the substantially uniform thickness of the outer sole is not greater than 3 mm.

10. A sole construction as claimed in claim 1, wherein the hardness of the natural or synthetic elastomeric material of the outer sole is not greater than 65 on the Shore A scale.

11. A sole construction as claimed in claim 10, wherein the hardness of the natural or synthetic elastomeric material of the outer sole lies in the range of 42 to 54 on the Shore A scale.

12. A sole construction as claimed in claim 1, wherein the outer sole is made from a polyurethane material.

13. A sole construction as claimed in claim 1, wherein a pliable insole is provided on the inner surface of the lining.

14. A sole construction as claimed in claim 13, wherein the insole is in whole or in part of a resilient foam material.

15. A sole construction as claimed in claim 13, wherein the insole is removable from the lining.

16. A sole construction as claimed in claim 1, wherein the lining is of a natural or synthetic leather material.

17. A sole construction as claimed in claim 16, wherein the lining is bonded to the inner surface of the inner sheet.

18. A shoe comprising a sole construction as claimed in claim 1 in combination with a shoe upper attached to the up-turned marginal region of the outer sole.

19. A shoe as claimed in claim 18, wherein the shoe upper is attached to the marginal region by one or both of stitching and bonding.

* * * * *